US005627578A

United States Patent [19]

Weintraub

[11] Patent Number: 5,627,578

[45] Date of Patent: May 6, 1997

[54] DESK TOP PRINTING OF RAISED TEXT, GRAPHICS, AND BRAILLE

[75] Inventor: Jeffrey Weintraub, Fort Washington, N.Y.

[73] Assignee: Thermotek, Inc., New York, N.Y.

[21] Appl. No.: 382,434

[22] Filed: Feb. 2, 1995

[51] Int. Cl.[6] ..... B41J 2/01; B41J 3/32; B41M 3/16

[52] U.S. Cl. ..... 347/101; 347/107; 118/46; 400/109.1

[58] Field of Search ..... 347/101, 102, 347/5, 107; 400/109.1; 118/46

[56] References Cited

U.S. PATENT DOCUMENTS

| | | | |
|---|---|---|---|
| 3,440,076 | 4/1969 | Vaurio . | |
| 4,095,233 | 6/1978 | Goffe | 347/101 |
| 4,101,688 | 7/1978 | Kurtzman | 427/56 |
| 4,227,200 | 10/1980 | Mansukhani | 347/101 |
| 4,312,268 | 1/1982 | King | 347/102 X |
| 4,599,627 | 7/1986 | Vollert | 347/101 X |
| 4,792,860 | 12/1988 | Kuehrle | 358/300 |
| 4,805,531 | 2/1989 | Sarda | 101/488 |
| 4,849,883 | 7/1989 | Mitchell et al. | 347/5 X |
| 4,943,816 | 7/1990 | Sporer | 347/101 X |
| 4,991,539 | 2/1991 | Sarda | 118/668 |
| 5,145,519 | 9/1992 | Kappele | 106/20 D X |
| 5,157,761 | 10/1992 | Hawkes | 395/107 |
| 5,164,232 | 11/1992 | Heseleit | 106/20 D X |
| 5,207,825 | 5/1993 | Schwarz, Jr. | 106/20 D X |
| 5,286,286 | 2/1994 | Winnik et al. | 106/20 D X |
| 5,328,504 | 7/1994 | Ohnishi | 106/20 D X |
| 5,345,254 | 9/1994 | Wong et al. | 347/100 |
| 5,397,673 | 3/1995 | Watson | 430/126 |

OTHER PUBLICATIONS

Loeber, N.C.; Braille Printed Dot Configoration, IBM JDB vol. 20, No. 3, Aug. 1977. p. 1204.
Power Publishing Catalog; Mar. 1994.
Costar Catalog; 1993.

*Primary Examiner*—Joseph W. Hartary
*Attorney, Agent, or Firm*—Graham & James LLP

[57] ABSTRACT

A method and device for raised letter or graphics printing, by means of a sprayed wet ink deposition on a print substrate. Subsequent dispensed thermographic powder thereon, with adherence of the powder only to the wet ink and heating thereafter, to a fixing temperature of the powder, results in the raised lettering or graphics. A standard portable ink jet printer of the bubble jet type, controlled, with graphics software control, by a personal computer, provides the requisite non-contacting ink deposition. The dispensing cartridge(s) of the ink jet printer is (are) provided with non-contact-drying ink formulations (with two or more separate colors, if desired) for the portion of graphics or printing which is to be in raised form. A thermographic powder dispenser and heating member is connected to the output of the ink jet printer, or integrated therewith for completion of the raised printing process. In operation, the non-contact drying ink is dispensed from the ink jet printer onto a print substrate, with program controlled bit-mapped instructions of graphics and text, via the personal computer. Simultaneous inking of the substrate with separate colored non-drying inks permits single pass multi-colored raised printing. Raised and non-raised printing is also possible by use of separately dispensed drying and non-drying inks. The device is particularly useful in providing non-impact formed braille lettering; and graphics, with full or partial raised portions and separated color segments.

5 Claims, 1 Drawing Sheet

DESK TOP PRINTING OF RAISED TEXT, GRAPHICS, AND BRAILLE

FIELD OF THE INVENTION

This invention relates to raised text and graphics printing and particularly to desk top personal thermographic printing of braille.

BACKGROUND OF THE INVENTION

Desk top publishing (local printing by means of specialized software and a personal computer) has become widespread to the point that personal computers readily permit the user to effect high grade printing and publishing with various controllable fonts and point sizes as well as with the ability to print bit-mapped graphics, either locally generated or from pre-packaged clip art. Printers of choice for such desk top publishing are of the Laserjet® (trademark of Hewlett Packard) or laser printer variety having copier engines and which operate with dry toner and developers. These printers operate at relatively high speed (currently on the order of from about 8–16 ppm) with high quality output (600 dpi and higher) and are capable of providing printing and graphics, limited only by available software.

A second, less popular (except in portable applications), slower (1–2 ppm), lower scale and less expensive printer type is that of the Deskjet® (trademark of Hewlett Packard) or inkjet variety, which, as the name implies, operates with the dispensing of an ink jet on paper or labels to effect the printing. These printers are similarly capable of providing printing and graphics (though usually with ink densities only in the 300 dpi range for inexpensive portable units), limited by available software. The most common of such printers use the bubble jet technology, wherein ink bubbles are controllably sprayed on the paper in the form of closely spaced dots (which dry upon contact with the paper), to form letter and number characters (text) and graphic art and designs. Specialized versions of these printers have multiple ink dispensing cartridges, which provide a multi-color printing capability in a low cost printer.

The aforementioned printers are not however capable of anything other than normal flat printing. Accordingly, higher scale stationery, such as business cards and letterhead paper, requiring raised lettering, are prepared by professional engravers or thermographers for printing the raised lettering. In the process used by the latter, text or graphic material to be raised is initially completed and then used to create a printing plate or duplicating sheets (similar to a stencil), image created xerographic type templates or similar print application means. The printing plate or similar print application means is then used in a printing press or the like to apply thermographic ink to a paper base. The inked paper is then subjected to a dusting with a thermographic powder, formulated to adhere only to the inked portion of the paper, with excess powder being removed from the paper and recycled. Thermographic activation heating to about 270°–300° F. is then used to cause the adhered powder and ink to rise, to form the raised text or graphics. With the current state of thermography it is not possible to print with alternate sites of raised and non raised lettering and/or graphics in a single pass. Instead two passes are required, one for the flat printing and one for the raised printing, with attendant problems of alignment and proper registration.

A second type of printing requiring raised characters is that of braille printing, i.e., representation of alphabet letters by raised dots (up to six dots/character) in varying configurations. These dots or characters, which are read by finger touch, must be of a minimal standard height (recommended height being 0.019 inches) for touch sensitive reading by the blind. Currently, the various means for braille printing are either very labor intensive, or require expensive machinery and processing. Thus, braille printing has been effected by using a braille typewriter which impresses dots on a heavy stock paper or cardboard, such that the dots are raised on the other side of the stock. Alternatively, pre-fabricated braille lettering is painstakingly adhered to a substrate. Recently, machines using a duplicating engine to provide substitutes for the printing plate, have been developed for printing of braille and other raised lettering and graphics in a thermographic process. These machines, however embody sophisticated technology, are very expensive, and are accordingly not amenable for use in common desk top publishing applications. Even with the sophistication of the machines, simultaneous printing of raised and non-raised portions is still not possible, such as the printing of regular text with corresponding clear raised braille print thereon.

It is therefore an object of the present invention to provide a low cost system for producing raised lettering and graphics in desk top publishing applications.

It is a further object of the present invention to produce such raised lettering and graphics by means of a personal computer and an inkjet type printer.

It is yet another object of the present invention to provide a means for the economical printing of braille lettering on regular paper and label stock.

It is a still further object of the present invention to provide a means for simultaneous printing text and graphics with predetermined raised and non-raised portions and/or with multiple colors.

These and other objects, features and advantages of the present invention will become more evident from the following discussion and drawings in which:

SHORT DESCRIPTION OF THE DRAWINGS

SUMMARY OF THE INVENTION

Figure 1:
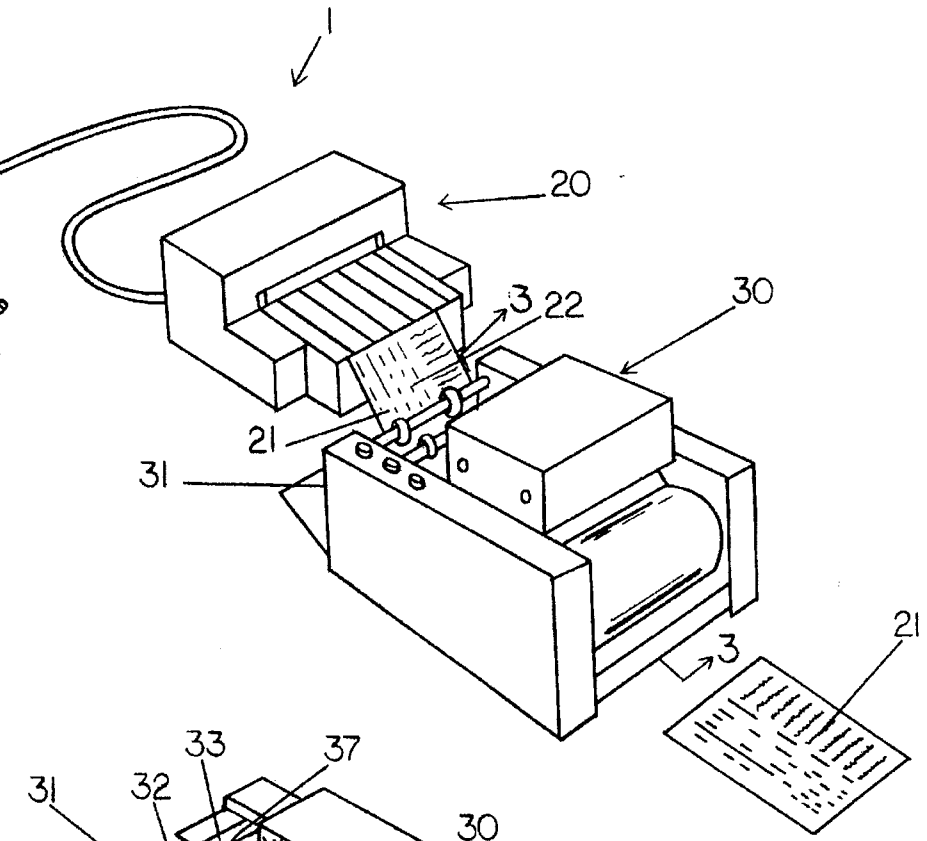
FIG. 1 is a schematic overview of the device of the present invention.

Generally the present invention comprises a method and a system for effecting the method, for the formation of raised lettering and/or graphics on substrates such as paper and label stock as well as cardboard, by utilizing desk top publishing software, controlling computer means (e.g., a personal computer), means for directly placing thermographically reactive ink on the substrate to be printed without the need for the formation of an intermediate printing plate, stencil, xerographic copy or the like. Such direct placement of the thermographically reactive ink onto the substrate to be printed, in the configuration which it is to be printed, is most preferably effected by controllably (e.g. with digital bit mapped instructions) spraying non-contact-drying ink onto the substrate to effect the desired lettering and/or graphics. Thereafter, the inked substrate is thermograpically treated (dusted with thermographic powder and heat treated), prior to drying of the ink, to raise the lettering and/or graphics defined by the initially sprayed ink. Spraying of the ink onto the substrate is without physical contact of ink dispensing means with the substrate. Ideally and economically the ink spraying is effected by means of a commercial ink jet printer.

DETAILED DESCRIPTION OF THE INVENTION

In accordance with the present invention the output from the inkjet printer is directly fed into a modified thermographic unit with thermographic powder dusting means, vibratory or other excess powder removal means (and recycling means) and thermographic heating means such as with radiant heating elements. Because of the slow relative speed of inkjet printer output from normal consumer inkjet printers, it is not usually necessary to provide extensive conveying units nor are there problems with premature ink drying prior to completion of the dusting with thermographic treatment. As a result, a relatively small inexpensive simple desktop thermographic unit can either be disposed with an input thereof from the output of an inkjet printer or integrated with an inkjet unit for operation, as described.

In accordance with the present invention the ink used to provide the wet substrate for the thermographic process, is preferably formulated from the standard inks used in inkjet printers in order to avoid any compatability problems. The ink is however reformulated to remove drying agents from the ink which cause the ink to normally dry on contact with the substrate. Only a slight change, with minor reduction of viscosity, occurs with such reformulation, without any significant effect on the operation of the inkjet printer. Many of the inkjet printers are designed for operation with water based inks (to prevent clogging) and accordingly a thermographic powder which will adhere thereto is preferably used. The water based ink may contain oil and the theremographic powder should be adherable thereto. The inks, without contained drying agents, should have a spontaneous character edge drying time (drying occurs from the edges inwardly) of at least several minutes in order to permit complete page printing and dusting with the thermographic powder, without loss of character or figure integrity. The dusting with the thermographic powder with the adherence of the powder to the inked portions, fixes the text and graphics for being raised and drying thereafter does not affect subsequent thermal processing for raising the text or graphics. Currently utilized ink jet inks are formulated as follows:

1) solvent—water (distilled);
2) colorant—water soluble dye or pigment;
3) humectant—e.g. diethylene glycol to facilitate flow;
4) fixant—ester or resin drying agent;
5) surface agent—alcohol for water flow.

Removal of fixant drying agents, provides a suitable ink for use in accordance with the present invention.

Variations in the initial ink color as well as variations in the specific thermographic powders being used, provides selective multi-coloring. More importantly, selective thermographic powders provide different degrees of raising of text or graphics. Thus, a thermographic powder with raising capability of at least 1 to 1.7 mils permits the formation, with appropriate software, of braille lettering which complies with federal standards for braille printing. In addition, the braille printing can be placed on labels and reqular paper stock, as well as normal braille stock base of cardboard (an inkjet printer modified to feed cardboard stock can be used to provide printing on cardboard as well), utilizations not normally possible with existing braille printing means. Furthermore, since the braille printing in accordance with the present invention is raised without effecting the obverse side of the paper, label or cardboard, it is readily possible to print braille on both sides of the print substrate. An example of a commercially available thermographic powder suitable for use in providing raised braille printing with acceptable height is a thermoplastic resin with a melting point falling between 100° C. to 270° C.

With appropriate conversion software (relative to any language and any braille language) a knowledge of braille is not even necessary to ensure proper conversion and correct braille printing, and as described above, it is possible to simultaneously print the underlying language and the braille print thereover. A monitor display shows the print field (in both underlying language and braille, if desired) prior to initial printing, for any desired changes prior to printing. With text scanners being widely and economically available, it is also possible to scan regular typed or printed text (and graphics) into a computer. With the appropriate conversion software, the scanned text is converted to braille and is nearly simultaneously printed out in raised braille print, all without any labor intensive text entry.

Low cost color inkjet printers are presently configured with two or more injet cartridges for selective application of different color inks. In accordance with the present invention, one cartridge can be supplied with contact drying ink and the other with ink formulated without drying agents. As a result, in a single pass of the device, portions of the print may be raised while other portions remain flat, with perfect alignment and registration. This dual printing has applicability, for example, in enhancing pie charts, in preparing figures for coloring pages, and, with appropriate software, the simultaneous printing of regular flat ink with clear braille corresponding information thereon. Variations in drying colored ink and non-drying color ink can provide numerous variations in flat and raised color graphics.

Specifics of structure and operation of ink jet printers are for example set forth in *Output Hardcopy Devices* edited by Robert C. Durbeck and Sol Sherr (Academic Press 1988), the disclosure of which is incorporated herein by reference thereto. As described in the aforementioned text, typical bubble jet type printers (the most prevalent consumer ink jet printer) utilize heat energy to vaporize a small portion of the ink to expel a drop through an adjacent orifice or nozzle which supplies a drop of ink on demand from the printer. Close groupings of the drops (e.g. 300–600 dpi) form the printer instructed text, characters, or graphics as the printhead scans the paper or similar substrate.

It is an additional advantage of the present invention that the raising of the lettering with the thermographic powder being adhered to the wet ink, causes an overall localized diffusion of the ink within each character or portion of graphics. As a result, graphics and text quality for the raised printing are improved well beyond the initial print quality.

DETAILED DESCRIPTION OF THE DRAWINGS AND THE PREFERRED EMBODIMENT

Figure 2:
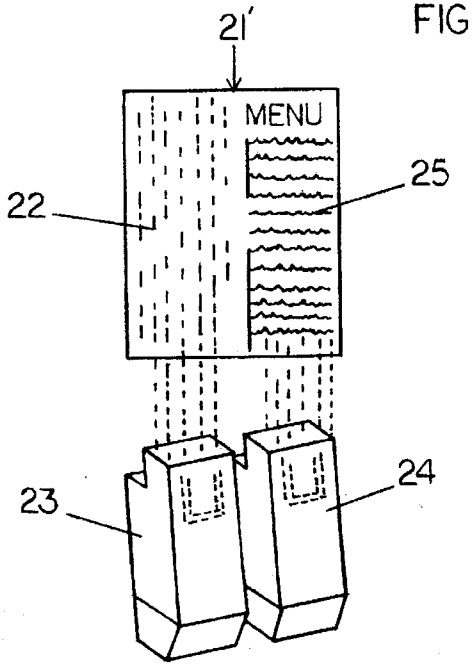
FIG. 2 is a schematic view of the operation of a bubble type ink jet printer shown in FIG. 1.

With respect to the drawings and with reference to FIG. 1, the desk top raised printing system 1 of the present invention is comprised of a controlling personal computer 10, loaded with desk top publishing, graphics, or braille conversion software depending on the application. The computer 10 is hooked up to inkjet printer 20 for hardcopy output 21 with wet ink portions 22. As is more clearly seen in FIG. 2, ink (with drying agents removed) is sprayed from ink cartridge 23 onto print substrate 21', with appropriate deflections, to form the desired characters or graphic figures with a density of about 300 dpi. Ink cartridge 24, filled with a contact drying ink provides, in a single printing on substrate 21', together with the wet inked portions 22, dry inked portions 25, which remain as flat printing.

Figure 3:
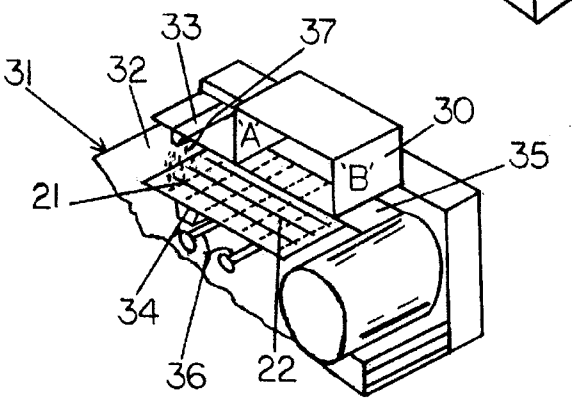
FIG. 3 is a schematic cutaway view of the modified thermograhic processing unit of FIG. 1 which is linked to the output of the ink jet printer shown in FIG. 2.

The hardcopy output 21 is thereafter immediately fed by gravity feed to the input 31 of thermographic unit 30. With further reference to FIG. 3, the thermographic unit 30 comprises feed member 32, thermographic powder dusting element 33, vibratory element 34 for removing excess non-adhered powder and heating elements 35. Rollers 36 move the output 21, through the zone A whereby the wet inked portions 22 have thermographic powder 37 adhered thereto and residual powder is vibrated free by vibratory element 34, whereby the thermographic powder remains only on the wet inked portions 22. The thermographically powder treated substrate is then carried by rollers 36 to zone B beneath heating elements 35, where the powder treated ink is raised for completion of the raised printing. As shown, the raised printing is in the form of a braille printed menu.

It is understood that the above description and drawings are illustrative of the present invention and that changes may be made in materials, ink dispensing and thermographic fixing equipment without departing from the scope of the present invention as defined in the following claims.

What is claimed is:

1. A system for printing raised text and/or graphics on a single sheet substrate, said system comprising:

a. an ink jet printer having at least one ink cartridge containing delayed drying ink, said ink jet printer being attached to controlling computer means having software instructions loaded therein, wherein wet, delayed drying ink, from the ink cartridge, is sprayed by the ink jet printer, in accordance with instructions from said software controlled computer means, on said single sheet substrate in the configuration of said text and/or graphics, b. means for conveying the inked single sheet substrate, while said delayed drying ink remains wet, to means for dusting the substrate with a thermographic powder which adheres only to said wet ink, c. means for removing excess thermographic powder; and d. means for heating the adhered thermographic powder to a temperature and for a time sufficient to raise the lettering and/or graphics defined by the initially placed ink to at least a height of 0.019 inches.

2. The system of claim 1, wherein said ink jet printer comprises at least two ink containing cartridges from which ink is separately sprayed in accordance with instructions from said software controlled computer means, and wherein at least one of said cartridges contains an ink which remains wet when sprayed on said substrate and wherein at least one of the ink containing cartridges contains an ink which dries when sprayed on said substrate.

3. The system of claim 1, wherein said text is in braille and said software instructions instruct the computer means to convert input text into braille output in the form of said wet ink placement, and wherein the thermographic powder provides a raised braille output of at least 0.019 inches height, and sufficient for touch sensitive reading.

4. A method for producing raised braille lettering comprising the steps of spraying a single sheet substrate, for said braille lettering, with a computer controlled ink jet printer spray of a non-contact-delayed drying ink which forms the desired braille lettering configuration, dusting said substrate, with wet ink thereon, with a thermographic powder which adheres only to said wet ink and which thermographic powder provides a raised braille output of at least 0.019 inches in height, and sufficient for touch sensitive reading, removing non-adhered powder and thereafter heating the adhered thermographic powder to produce said raised braille lettering.

5. A method for simultaneously printing raised and flat text and/or graphics on a substrate, comprising the steps of simultaneously spraying the substrate with a non-contact-delayed drying ink and a contact drying ink the form of said raised and flat text and/or graphics respectively, dusting said substrate, with wet and dry ink thereon, with a thermographic powder which adheres only to said wet ink, removing non-adhered powder and thereafter heating the adhered thermographic powder to produce said raised text and/or graphics only in a configuration as defined by the wet ink.

* * * * *